US005762014A

United States Patent [19]

JeanBlanc

[11] Patent Number: 5,762,014

[45] Date of Patent: Jun. 9, 1998

[54] NEEDLE GUIDE COMPONENTS FOR A SEWING MACHINE

[76] Inventor: Ferdinand H. JeanBlanc, 251 Frederick Ave., Harrison, Id. 83833

[21] Appl. No.: 393,223

[22] Filed: Feb. 23, 1995

Related U.S. Application Data

[63] Continuation of Ser. No. 131,441, Oct. 4, 1993, Pat. No. 5,425,320.

[51] Int. Cl.[6] ..... D05B 55/06; D05B 29/00

[52] U.S. Cl. ..... 112/227; 112/235

[58] Field of Search ..... 112/227, 321, 112/260, 312, 235

[56] References Cited

U.S. PATENT DOCUMENTS

| | | | |
|---|---|---|---|
| 2,577,430 | 12/1951 | Peterson et al. | 112/227 X |
| 3,094,087 | 6/1963 | Thorne . | |
| 3,107,639 | 10/1963 | Basile | 112/227 |
| 3,313,259 | 4/1967 | Daniel et al. | 112/227 X |
| 5,425,320 | 6/1995 | JeanBlanc | 112/227 |
| 5,520,127 | 5/1996 | JeanBlanc | 112/227 |

*Primary Examiner*—Paul C. Lewis
*Attorney, Agent, or Firm*—Delbert J. Barnard

[57] ABSTRACT

An upper needle guide (10) and a lower needle guide (40) for guiding a sewing needle during a stitching operation in order to keep the sewing needle laterally aligned along a stitching path so that the thread loop thrown by the sewing needle beneath the material being sewn is in alignment with the path of movement of a thread loop pick-up device (98). The upper needle guide includes a needle hole having a thread relief passageway (22) therein for providing a relief space for the sewing thread (34) as the needle moves through the needle hole. The lower needle guide includes a thread and needle slot (44) having a pair of V-shaped notches (46) therein. The V-shaped notches are aligned with the stitching path (84). In an alternative embodiment, the lower needle guide can comprise a feed dog (52) having a diamond-shaped needle hole (58) therein.

3 Claims, 6 Drawing Sheets

Fig. 15
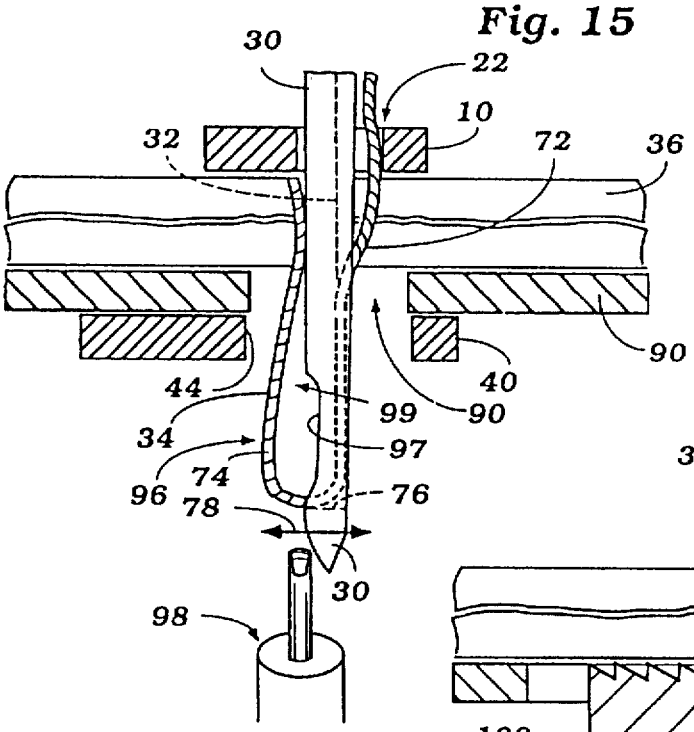
Fig. 16
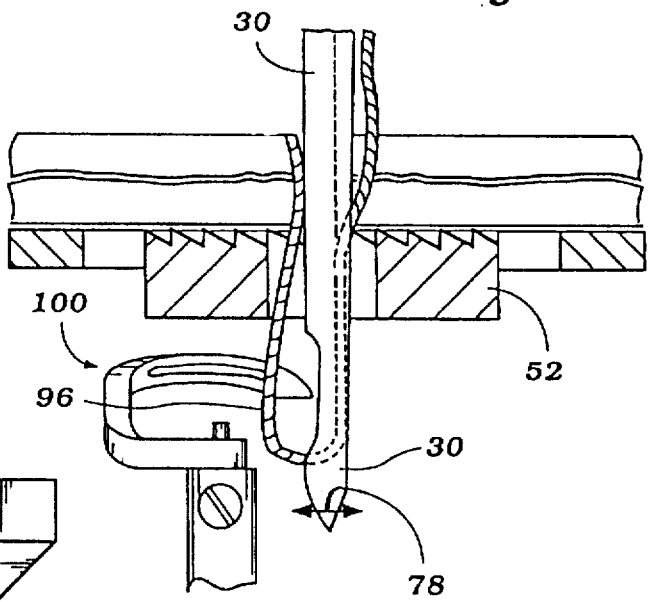
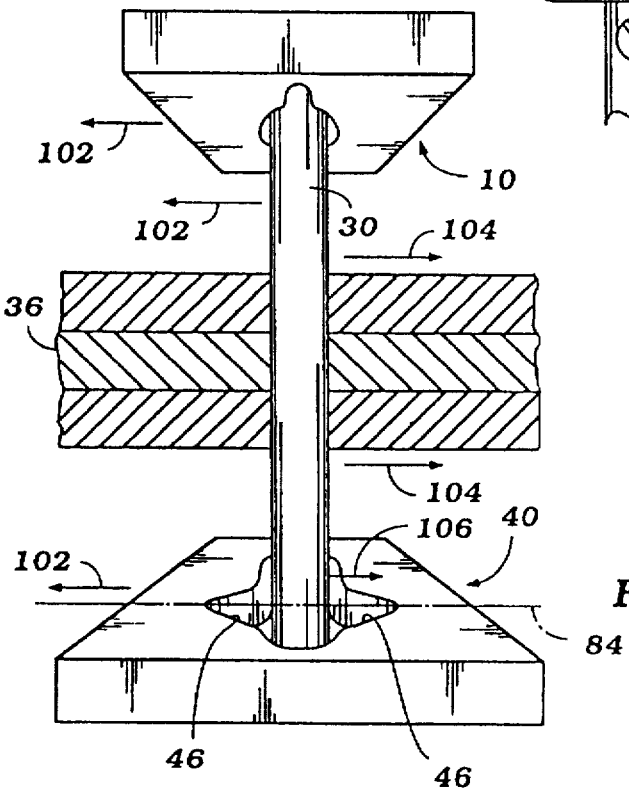
Fig. 17

NEEDLE GUIDE COMPONENTS FOR A SEWING MACHINE

TECHNICAL FIELD

This application is a continuation of application Ser. No. 08/131,441, filed Oct. 4, 1993 now U.S. Pat. No. 5,425,320.

This invention relates to sewing machine components for guiding and aligning a sewing needle as the sewing needle penetrates material being sewn and throws a thread loop below the material.

BACKGROUND OF THE INVENTION

As a sewing needle descends and penetrates material being sewn, the material sometimes can deflect the sewing needle sideways either laterally or longitudinally with respect to the stitching path. When this occurs, the loop thrown by the sewing needle beneath the material can be positioned out of alignment with the path of movement of a thread loop pick-up device. A thread loop pick-up device could be, for example, a shuttle hook, a rotary hook, or a thread looper. U.S. Pat. No. 2,577,430, entitled, "Needle Feed Sewing Machine" of A. C. Peterson et al, granted Dec. 4, 1951, discloses a sewing machine utilizing a thread looper. My prior U.S. Pat. No. 4,991,526, entitled, "Bedplate Insert and Presser Foot, Each Having a Guide Surface for Laterally Supporting a Sewing Machine Needle," granted Feb. 12, 1991, discloses a sewing machine utilizing an oscillating shuttle hook.

If the thread loop is out of alignment with the thread loop pick-up device, the sewing machine can miss a stitch. One cause of needle deflection is inconsistencies within the sewn material. The weave of the sewn material sometimes is not perfectly even or perfectly gridlike, and the fibers of the material can vary in thickness. Consequently, if the weave is at a bias, or at an angle going across the material, the needle naturally follows the angle of the weave, causing slight needle deflection.

In addition, certain types of non-woven material, such as leather, also have inconsistencies. The fibers that make up the animal hide are not entirely uniform. For example, depending on the part of the animal from which the leather comes, there are hard and soft spots, as well as scars, bites, and other inconsistencies, which may appear smooth, but which can cause needle deflection.

Other types of stiffer, more durable material, such as Kevlar, carbon fibers, plastics, and nylon webbings, for example, due to their rigidity and other factors, can cause needle deflection.

The foregoing causes of needle deflection are just some of the causes known to the inventor that can lead to missed stitches. These causes, as well as other causes, need to be controlled in order to minimize needle deflection and to ensure proper stitch formation.

In a sewing machine employing a needle feed mechanism, needle deflection during penetration of the material can be exacerbated when the material is advanced along the work surface of the sewing machine. In a needle feed mechanism, the sewing needle reciprocates back and forth along the stitching path, either alone or in conjunction with other components, such as a feed dog, to advance the material along the work surface of the sewing machine. When the needle reciprocates backward to advance the material, the natural resistance of the material tends to pull on the needle. As a result, the needle can be deflected out of alignment with the stitching path and, therefore, out of alignment with the path of movement of the thread loop pick-up device. When out of alignment, the thread loop thrown by the misaligned sewing needle can be missed by the thread loop pick-up device, which results in a missed stitch.

Accordingly, the present invention is directed toward a needle guide design for keeping the sewing needle aligned along the stitching path and with the thread loop pick-up device to reduce the occurrence of missed stitches.

DISCLOSURE OF THE INVENTION

Briefly described, the present invention comprises an upper needle guide for a sewing machine for guiding a sewing needle as the needle penetrates into material being sewn. The sewing machine includes a work surface for supporting the material, a drive mechanism for moving the sewing needle into and out of the material, and a thread loop pick-up device below the work surface. The sewing needle includes a longitudinal groove for providing a passageway for a thread along the sewing needle to the eye of the needle. The sewing needle is adapted to throw a loop in the thread below the material, with the thread loop being thrown in alignment with the path of movement of the thread loop pick-up device, so that the thread loop pick-up device catches the thread loop and avoids missing a stitch. The upper needle guide includes a needle hole, slightly larger than the dimensions of the sewing needle, to create a close engagement between the upper needle guide and the sewing needle. The needle hole extends through the upper needle guide and creates an annular edge surface for guiding the sewing needle. The upper needle guide also includes a thread relief passageway in the form of a groove, at the annular edge surface of the needle hole. The thread relief passageway extends through the upper needle guide and is positioned at a point around the annular edge surface adjacent the longitudinal groove in the sewing needle. The thread relief passageway provides relief space for the thread in the longitudinal groove of the sewing needle. Any deflection of the sewing needle caused by the material as the needle moves down through the material is minimized by the close engagement of the sewing needle and the needle hole. As the sewing needle descends, the thread is confined in the space defined by the adjacent grooves in the upper needle guide and the sewing needle and avoids getting pinched between the sewing needle and the upper needle guide.

Preferably, the sewing needle is round and the needle hole, likewise, is also round, and the groove in the needle hole is semicircular and of sufficient dimension to accommodate the thread.

The upper needle guide can be fixedly mounted to the sewing machine in a sewing machine employing, for example, a bottom feed or a drop feed-type sewing mechanism. For a sewing machine employing a compound feed mechanism, the upper needle guide can comprise the center feed bar of the compound feed apparatus.

The present invention also comprises a lower needle guide for aligning a sewing needle of a sewing machine having a needle feed mechanism for advancing material being sewn. A sewing machine with the lower needle guide of the present invention includes a work surface for supporting the material and drive mechanism for moving the sewing needle into and out of the material through the lower needle guide to throw a loop in the thread. The drive mechanism also moves the sewing needle back and forth along a stitching path to advance the material. The sewing machine further has a thread loop pick-up device below the work surface. The lower needle guide includes a V-shaped notch extending through the lower needle guide. The V-shaped notch faces the direction of material advancement and has its apex aligned along the stitching path. The sewing needle is adapted to move through the needle hole adjacent the V-shaped notch. When the needle feed mechanism advances the material, if the sewing needle is out of alignment with the stitching path, the material urges the sewing needle longitudinally along the stitching path into the V-shaped notch. This aligns the sewing needle laterally along the stitching path at the apex of the V-shaped notch. As a result, the thread loop thrown by the sewing needle aligns with the path of movement of the thread loop pick-up device.

Preferably, two V-shaped notches are provided. The two V-shaped notches face each other and have their apexes aligned along the stitching path. The two notches provide for needle alignment in both forward and reverse stitching directions.

According to another aspect of the invention, the apexes of the V-shaped notches converge to a width less than the diameter of the sewing needle. This allows the V-shaped notches to seat the needle at the apex of the notches and precisely along the stitching path prior to the needle throwing a thread loop. The needle hole is sufficiently large to allow a minimal degree of lateral deflection in the sewing needle as the needle penetrates the material and enters the needle hole of the lower needle guide. In addition, the sides of the V-shaped notches function to re-deflect the sewing needle back along the stitching path should the material deflect the sewing needle as the needle penetrates the material.

For a sewing machine employing a compound feed mechanism, the lower needle guide comprises a needle guide plate positioned beneath the work surface of the sewing machine. The needle guide plate moves in conjunction with the sewing needle and a feed bar to advance the material along the work surface. The V-shaped notches in the guide plate catch the lower portion of the sewing needle should the material urge the sewing needle out of alignment with the path of movement of the thread loop pick-up device.

For a sewing machine employing a feed dog apparatus, the lower needle guide includes a needle hole having a V-shaped notch extending through the feed dog. The V-shaped notch faces in the direction of material advancement. As the feed dog and sewing needle move back along the stitching path to advance the material, the V-shaped notch aligns the sewing needle should the material tend to deflect the sewing needle out of alignment with the path of movement of the thread loop pick-up device.

According to another aspect of the invention, the feed dog may comprise a pair of V-shaped notches that face each other and are adjacent each other to form a diamond-shaped needle hole opening in the feed dog. The diamond-shaped opening aligns the sewing needle when the sewing machine sews in both a forward and reverse direction.

The thread loop pick-up device may comprise, for example, a shuttle hook, a rotary hook, or a thread looper commonly used to form varous types of stitches, such as lock stitches and chain stitches.

Other objects, advantages and features of the present invention will become apparent from the following description and accompanying drawings and the claims, which are all incorporated herein as part of the disclosure of the invention.

BRIEF DESCRIPTION OF THE DRAWINGS

Like reference numerals are used to indicate like parts throughout the various figures of the drawing, wherein:

FIG. 15 is a schematic drawing of a compound feed mechanism including the upper needle guide of FIG. 1 and the lower needle guide of FIG. 7, illustrating a sewing needle throwing a thread loop beneath the material being sewn;

FIG. 16 is a schematic drawing of a needle feed mechanism including the feed dog of FIG. 9;

FIG. 17 is a schematic drawing of the upper needle guide and the lower needle guide of FIG. 15 illustrating the material pulling on the sewing needle as the sewing needle advances the material;

BEST MODE FOR CARRYING OUT THE INVENTION

Figure 1:
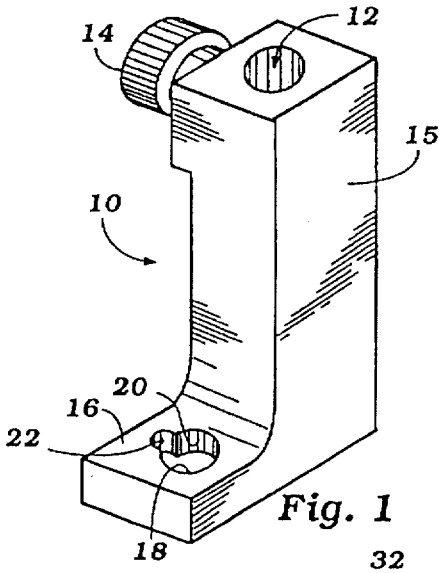
FIG. 1 is an isometric view of the upper needle guide of the present invention.
Figure 2:
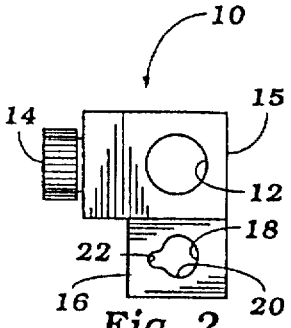
FIG. 2 is a top view of the upper needle guide of FIG. 1.

Referring to FIGS. 1 and 2, an upper needle guide 10 is shown. The upper needle guide 10 can be part of an orbiting center feed bar of a compound feed mechanism or simply a stationary guide bar that can be, for example, part of a bottom feed mechanism. In either case, the upper needle guide 10 mounts onto a guide bar (not shown) that inserts through hole 12 and is secured to the upper needle guide 10 by means of set screw 14. The upper needle guide 10 includes an upright shank 15 and a horizontal guide plate portion 16 extending from the lower portion of the upper needle guide 10. The guide plate portion 16 includes a needle hole 18 that creates an annular edge surface 20 for guiding a sewing needle. A thread relief passageway 22, in the form of a groove, is positioned at the annular edge surface 20 of the needle hole 18. The thread relief passageway 22, as well as the needle hole 18, extend through the guide plate portion 16 of the needle guide 10.

Figure 3:
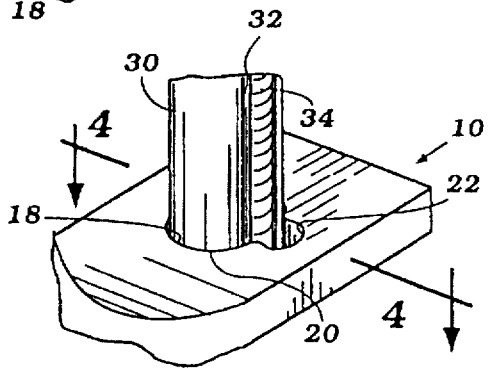
FIG. 3 is a fragmentary isometric view of the upper needle guide of FIG. 1 shown with a sewing needle moving therethrough.
Figure 4:
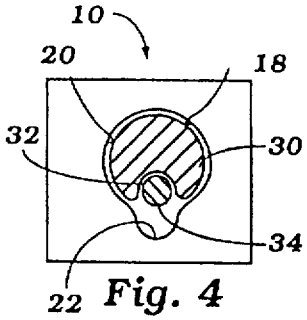
FIG. 4 is a sectional view taken along the line 4—4 of FIG. 3.

FIGS. 3–6 illustrate a sewing needle 30, carrying a sewing thread 34, extending through the needle hole 18 of the upper needle guide 10. As shown in FIG. 3, the sewing needle 30 includes a longitudinal groove 32. The longitudinal groove 32 is best shown in FIG. 4. The longitudinal groove 32 provides a recessed passageway for the sewing thread 34. The longitudinal groove 32 extends along the length of the sewing needle 30 and leads to a needle eye of the sewing needle 30. As such, the longitudinal groove 32 provides a passageway for the sewing thread 34 along the length of the sewing needle 30 leading to the needle eye of the sewing needle 30.

The needle hole 18 is slightly larger than the dimensions of the sewing needle 30. This creates a close engagement between the annular edge surface 20 of the upper needle guide 10 and the sewing needle 30.

Figure 5:
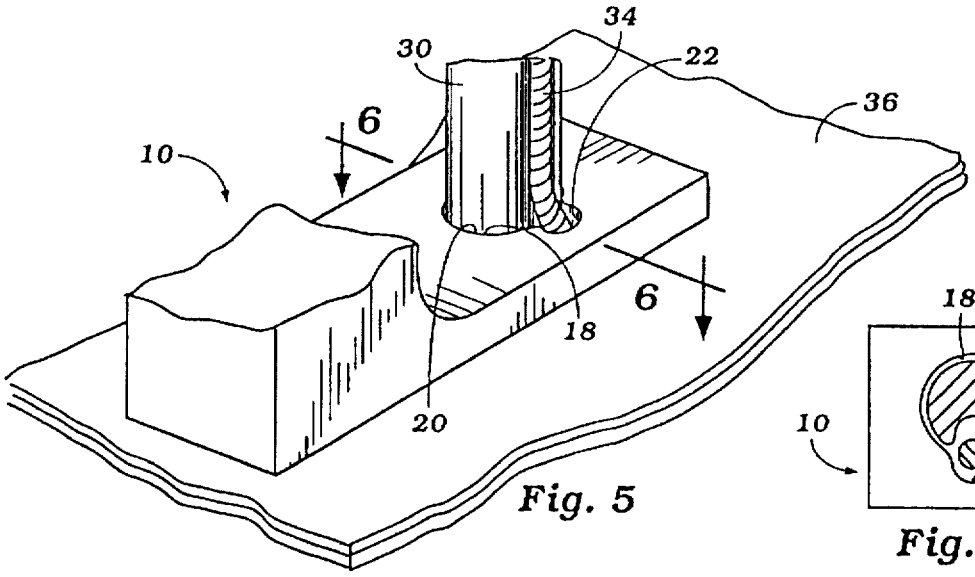
FIG. 5 is a fragmentary view of the upper needle guide of FIG. 1 shown with a sewing needle passing through the upper needle guide and through material being sewn.
Figure 6:
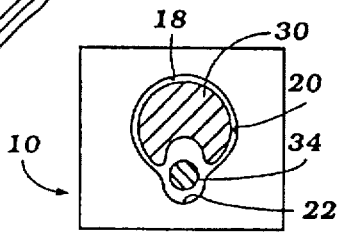
FIG. 6 is a sectional view taken along the line 6—6 of FIG. 5.

The upper needle guide 10 is mounted to its guide bar in a manner so that the thread relief passageway 22 is adjacent the longitudinal groove 32 of the sewing needle 30. The thread relief passageway 22 provides relief space for the sewing thread 34, as shown in FIGS. 5 and 6, as the sewing needle 30 moves through the needle hole 18 of the upper needle guide 10 and penetrates material 36 being sewn. Should the sewing thread 34 move out of the longitudinal groove 32 of the sewing needle, the thread relief passageway 22 provides a relief space for the sewing thread 34. This avoids the sewing thread 34 from getting pinched between the sewing needle 30 and the annular edge surface 20 of the upper needle guide 10. Consequently, the sewing thread 34 can pass freely through the upper needle guide 10.

As the sewing needle 30 penetrates the material 36, the material 36 can deflect the sewing needle 30. This is particularly true for tougher, more rigid material, such as leather, nylon, and carbon fiber material. The provision of a thread relief passageway 22 allows the needle hole 18 to be no more larger than the dimension of the sewing needle than necessary to allow the sewing needle to reciprocate freely through the needle hole. This creates a close engagement between the sewing needle 30 and the annular edge surface 20 of the needle guide. The close engagement between the sewing needle 30 and the needle hole 18 helps to minimize any needle deflection caused by the material. However, with the needle hole 18 sized slightly larger than the sewing needle 30, it is desirable to have a thread relief passageway at the annular edge surface of the needle hole in alignment with the longitudinal groove of the sewing needle. The adjacent grooves 22, 32 provide sufficient space for the sewing thread 34 so that the thread can move freely through the upper needle guide 10.

Figure 7:
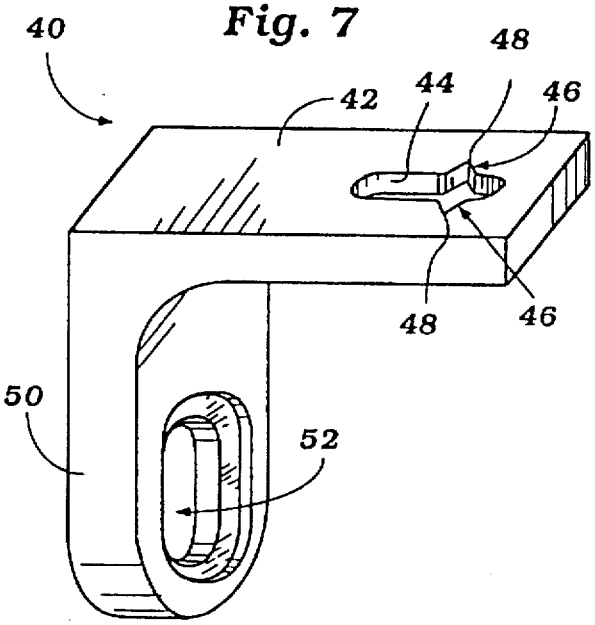
FIG. 7 is a perspective view of a first embodiment of the lower needle guide of the present invention.
Figure 8:
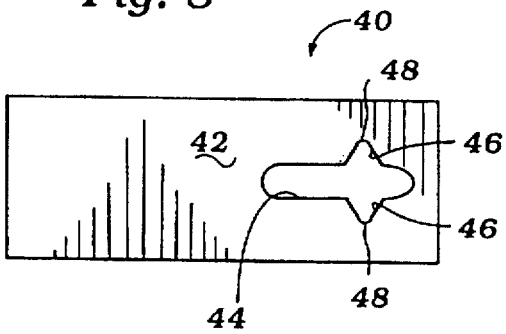
FIG. 8 is a top view of the lower needle guide of FIG. 7.

FIGS. 7 and 8 disclose a first embodiment for a lower needle guide 40. The lower needle guide 40 includes a guide plate portion 42 having a needle and thread slot 44 extending through the guide plate portion 42. The needle and thread slot 44 includes a pair of V-shaped notches 46 having apexes 48. The lower needle guide 40 includes a shank portion 50 having a bolt hole 52 for mounting the lower needle guide 40 to an eccentric (not shown) that is part of a four-motion drive mechanism, commonly known to drive a feed dog.

Figure 9:
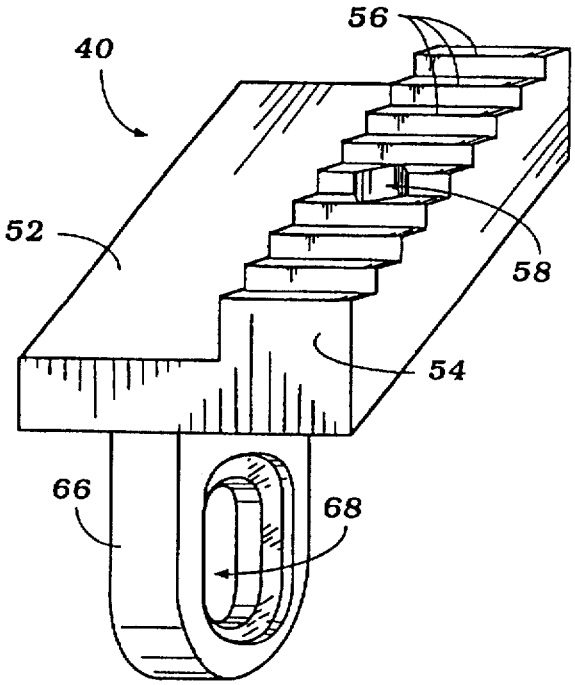
FIG. 9 is a perspective view of an alternative embodiment of the lower needle guide, shown in the form of a feed dog.
Figure 10:
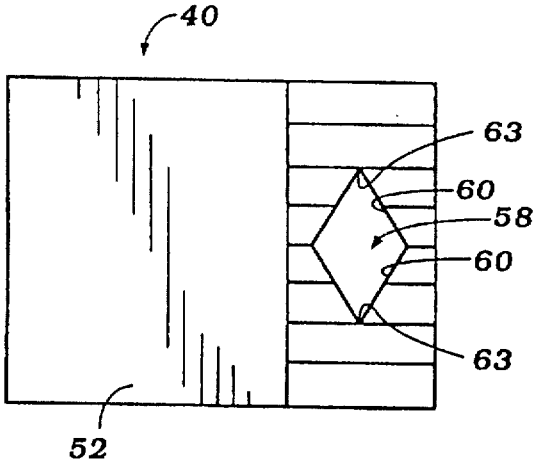
FIG. 10 is a top view of the feed dog of FIG. 9.

FIGS. 9 and 10 show a second embodiment of a lower needle guide 40 in the form of a feed dog 52. The feed dog 52 includes an elevated portion 54 that has an array of cleats 56 for engaging the material being sewn. A needle hole 58 extends through the feed dog 52. Preferably, the needle hole 58 is diamond shaped, as shown in FIG. 10, formed by two opposed V-shaped notches 60 having apexes 63. The lower portion of the feed dog 52 includes a shank 66 including a bolt hole 68 for mounting the feed dog 52 onto an eccentric, or feed motion cam, in a similar manner to the mounting of the lower needle guide 40 of FIG. 7.

The lower needle guide 40 of FIGS. 7 and 8 is adapted to be used on a sewing machine employing a compound feed mechanism for advancing the material. On the other hand, the feed dog 52 with its diamond-shaped needle hole 58, shown in FIGS. 9 and 10, is adapted to be used as part of a needle feed mechanism for advancing the material. A compound feed mechanism and a needle feed mechanism are discussed later.

Figure 11:
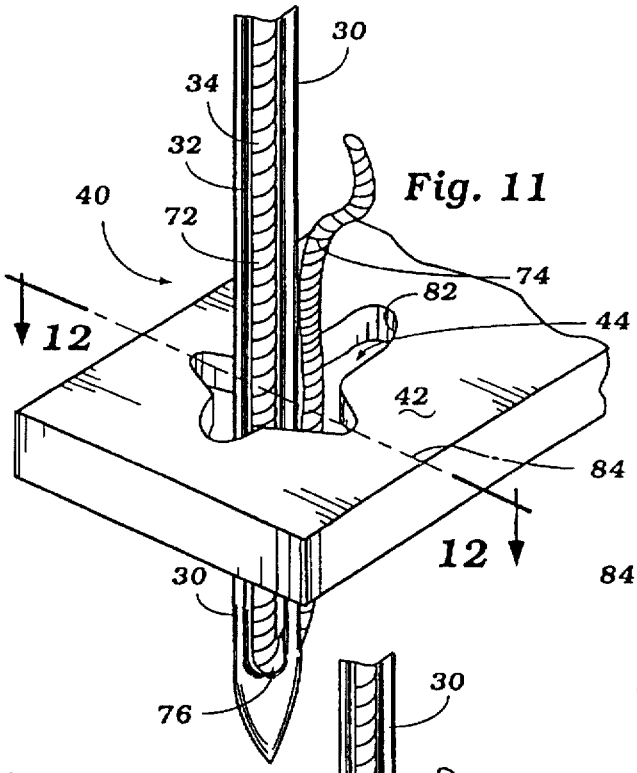
FIG. 11 is an isometric view of the lower needle guide shown with the sewing needle moving therethrough.
Figure 12:
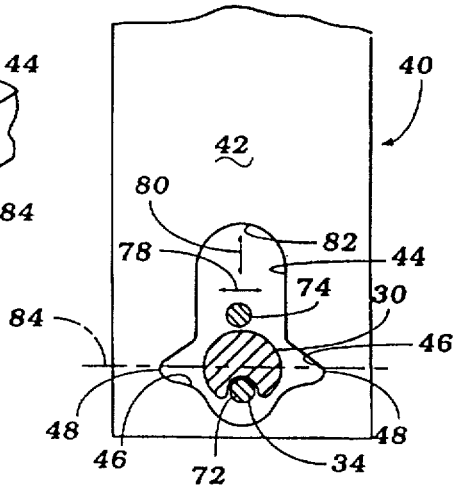
FIG. 12 is a sectional view taken along the line 12—12 of FIG. 11.

FIGS. 11 and 12 illustrate the sewing needle 30 carrying a sewing thread 34 through the thread and needle slot 44 of the lower needle guide 40 of FIGS. 7 and 8. At this point in the sewing process, the sewing thread 34 includes a first thread portion 72 extending from a thread supply bobbin, typically mounted on the upper portion of the sewing machine. The sewing thread 34 also includes a second thread portion 74 that extends from the previously-formed stitch in the material. The thread portions 72, 74 meet at the needle eye 76 of the sewing needle 30.

As best shown in FIG. 12, the thread and needle slot 44 is of sufficient dimension to accommodate any deflection of the sewing needle caused by the material. As the sewing needle 30 penetrates the material, should the sewing needle 30 be deflected either laterally, as indicated by arrow 78, or longitudinally, as indicated by arrow 80, the thread and needle slot 44 is sufficiently large to prevent the sewing needle from contacting the guide plate portion 42 of the lower needle guide. Such contact can cause breakage of the sewing needle. As the sewing needle 30 moves through the lower needle guide 40, thread portion 72 is carried within the longitudinal groove 32 of the sewing needle, and thread portion 74 is positioned on the opposite side of the sewing needle adjacent the extended portion 82 of the thread and needle slot 44.

In FIG. 12, reference numeral 84 depicts the stitching path of the sewing needle 30. The direction of stitch formation can be either to the right or left, depending on whether the sewing machine stitches in a forward or reverse direction. The apexes 48 of the V-shaped notches 46 of the thread and needle slot 44 align along the stitching path 84 of the sewing needle 30.

Figure 13:
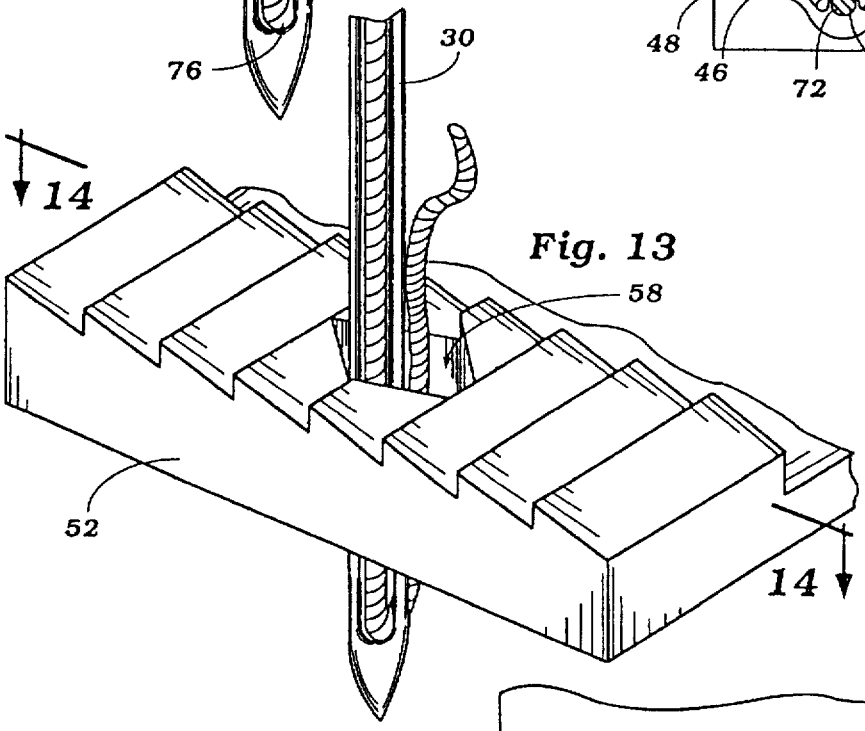
FIG. 13 is a fragmentary isometric view of the feed dog of FIG. 9 shown with a sewing needle moving therethrough.
Figure 14:
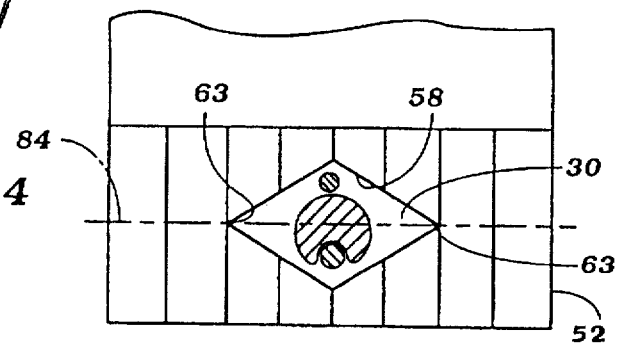
FIG. 14 is a sectional view taken along the line 14—14 of FIG. 13.

FIGS. 13 and 14 show the sewing needle 30 moving downwardly through the diamond-shaped needle hole 58 in the feed dog 52.

The diamond-shaped needle hole 58, like thread and needle slot 44, is of sufficient dimension to accommodate any lateral deflection of the sewing needle 30 caused by the material. The apexes 63 of the diamond-shaped needle hole 58 are aligned along the stitching path 84 of the sewing needle. As shown in FIGS. 11–14, the sewing needle 30 has entered the needle holes 44, 58 of the lower guide plate 40 and feed dog 52, respectively, without any deflection occurring.

FIGS. 15 and 16 illustrate the importance of having the sewing needle 30 laterally aligned with the stitching path. In FIGS. 15 and 16, the stitching path is into the page. Any deflection of the sewing needle 30 to the right or left, as indicated by arrow 78, would be lateral deflection. FIG. 15 illustrates a compound feed mechanism having the upper needle guide 10 and lower needle guide 40 shown in FIGS. 1 and 7. As shown in FIG. 15, the sewing needle 30 moves through the upper needle guide 10, through the material 36, through an opening 90 in the work surface or throat 92 of the sewing machine, and through the thread and needle slot 44 of the lower needle guide 40. The sewing needle 30 carries the thread 34, with thread portion 72 extending from the upper thread bobbin on the sewing machine, and with the thread portion 74 extending from a previous stitch. The thread portion 72 extends along one side of the sewing needle and, typically, within the longitudinal groove 32 of the sewing needle 30. However, the thread relief passageway 22 allows the thread portion 72 to move out of the longitudinal groove 32, if necessary. The sewing thread 34 extends around the needle eye 76, and thread portion 74 extends outwardly of the sewing needle 30 on the side of the needle opposite the thread portion 72. In a typical sewing operation, the sewing needle 30 throws a loop 96 in thread portion 74 so that the thread loop 96 can be picked up by a thread loop pick-up device, depicted in FIG. 15 as a shuttle hook 98. The sewing needle 30 includes a recess portion 97 that faces the thread loop portion 96. The recess portion 97, along with the thread loop 96, create an opening 99 through which the thread loop pick-up device 98 can move to catch the sewing thread 34. If the sewing needle 30 has been deflected laterally, as indicated by arrow 78, it is possible that the thread loop pick-up device 98 will not catch the sewing thread 34, and a stitch will be missed.

FIG. 16 illustrates the thread loop-forming process for a sewing machine utilizing a needle feed mechanism including the feed dog 52 of FIGS. 9 and 10. Illustrated in FIG. 16 is a thread loop pick-up device 100 in the form of a thread looper. As with a shuttle hook, it is equally important that the sewing needle 30 be laterally aligned along the stitching path so that the thread looper can pick up the thread loop 96 formed by the sewing needle 30. Shuttle hooks and thread loopers are known in the art, and their structure and operation will not be discussed herein beyond the extent necessary to understand the present invention.

FIG. 17 illustrates the function of the V-shaped notches 46 in the lower needle guide 40. In a compound feed mechanism, the upper needle guide 10, the sewing needle 30, and the lower needle guide 40, in unison, move back along the stitching path 84, in the direction of arrows 102, to advance the material 36. When this happens, the material 36 can tend to resist the advancement. This is particularly true for tougher, heavier material, such as leather. When the compound feed mechanism is advancing the material in the direction of arrow 102, the material tends to resist advancement and pull on the sewing needle 30 in the direction of arrow 104. This causes the lower portion of the sewing needle 30 to be deflected longitudinally in the direction of arrow 106.

Figure 18:
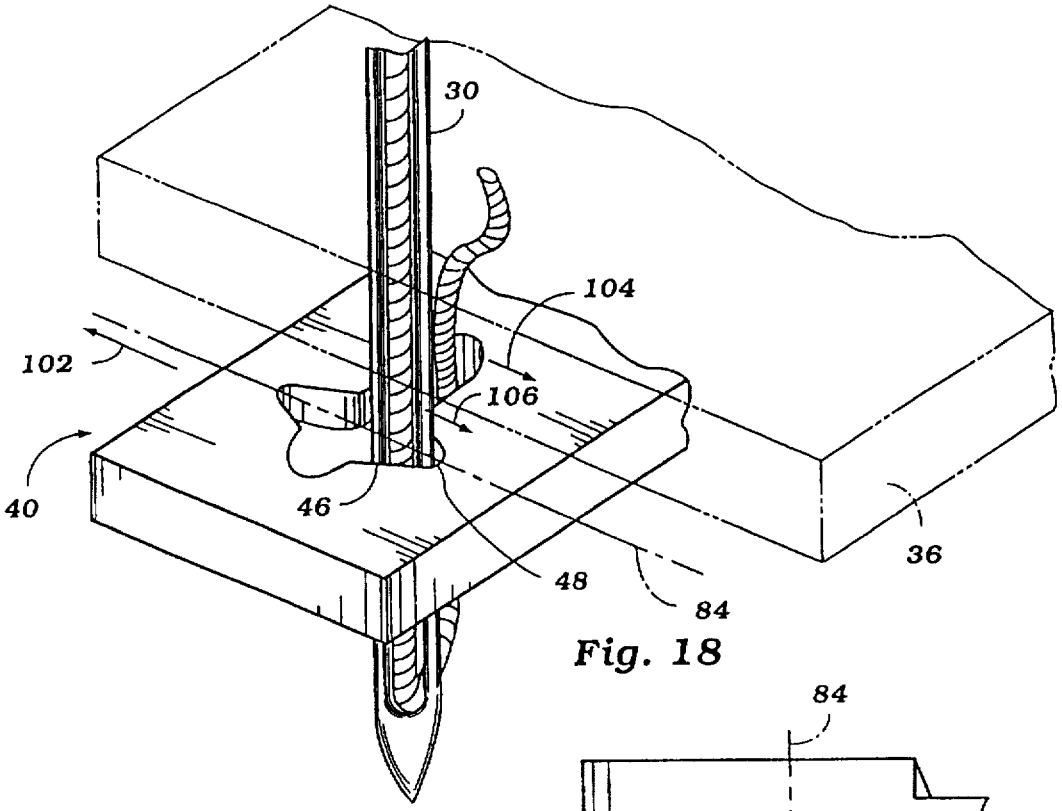
FIG. 18 is a fragmentary isometric view of the lower needle guide of FIG. 7 illustrating the material deflecting the sewing needle into a V-shaped notch of the lower needle guide.
Figure 19:
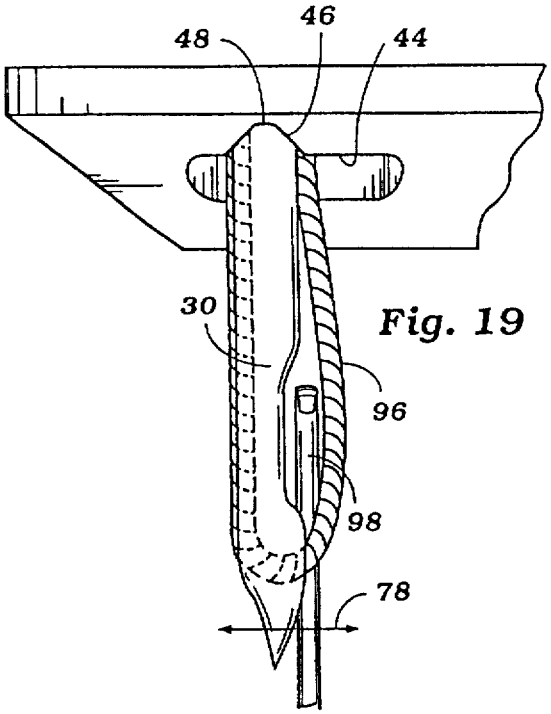
FIG. 19 is a fragmentary perspective view of the underside of the lower needle guide of FIG. 18, illustrating a shuttle hook positioned to catch the thread loop thrown by the sewing needle.
Figure 20:
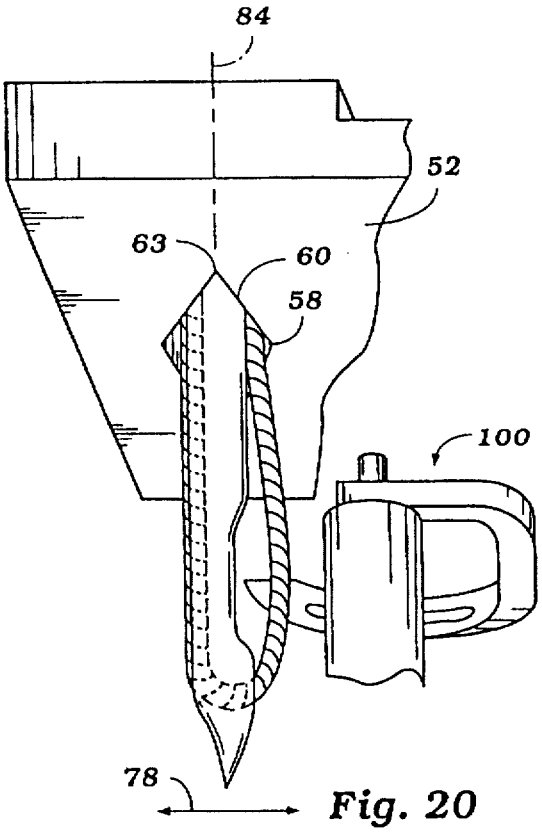
FIG. 20 is a perspective view of the underside of the feed dog of FIG. 16 illustrating the sewing needle seating in a V-shaped notch within the feed dog, positioning the thread loop thrown by the sewing needle in alignment with the path of movement of a thread looper.

The deflection of the lower portion of the sewing needle 30 is best illustrated in FIGS. 18–20. In FIG. 18, the sewing needle 30 and the lower needle guide 40 move in the direction of arrows 102 as the material 36 pulls on the sewing needle in the direction of arrow 104. The lower portion of the sewing needle 30 moves in the direction of arrow 106. V-shaped notch 46 of the lower needle guide 40 is positioned to catch the sewing needle 30 as the sewing needle 30 is deflected longitudinally toward the notch. When the sewing needle 30 enters the notch 46, the V-shaped design of the notch seats the sewing needle 30 at the apex 48 of the notch. This causes the sewing needle 30 to re-deflect laterally into alignment with the stitching path 84 if the needle was initially deflected laterally as it penetrated the material.

As shown in FIG. 19, as the sewing needle 30 is re-deflected laterally by V-shaped notch 46 of slot 44 into the apex 48 of the notch 46, it is aligned along the stitching path 84. This re-aligns the sewing needle 30 laterally, as indicated by arrow 78, so that the thread loop 96 thrown by the sewing needle is in alignment with the path of movement of the thread loop pick-up device 98. In FIG. 19, the thread loop pick-up device is depicted as a shuttle hook 98.

The V-shaped notches 60 of the diamond-shaped hole 58 in the feed dog 52 function in a similar manner to the V-shaped notches 46. As shown in FIG. 20, if the material tends to pull on the sewing needle 30, the lower portion of the sewing needle seats within a V-shaped notch 60 of the feed dog 52 and is aligned at the apex 63 of the notch. This aligns the sewing needle along the stitching path 84. With the sewing needle aligned laterally, as depicted by arrow 78, at the apex 63 of the notch 60, the thread loop 96 thrown by the sewing needle 30 is in alignment with the path of movement of a thread loop pick-up device, depicted in FIG. 20 as a thread looper 100.

It should be noted that a compound feed mechanism can be used in combination with a thread looper or other types of thread loop pick-up devices, and a needle feed mechanism employing a feed dog can be used in conjunction with a shuttle hook, as well as other types of thread loop pick-up devices.

The second V-shaped notch shown in the figures comes into play when the sewing machine stitches in a reverse direction. Since the vast majority of most stitching operations are performed in a forward stitching direction, it is feasible to design a sewing machine with a lower needle guide or feed dog having only one V-shaped notch. The V-shaped notch would be positioned adjacent the needle hole and form an ice cream cone-like needle hole. With only a single V-shaped notch, it is necessary that the notch face the direction of material advancement, which is the direction indicated by arrows 102 in FIGS. 17 and 18.

Figure 21:
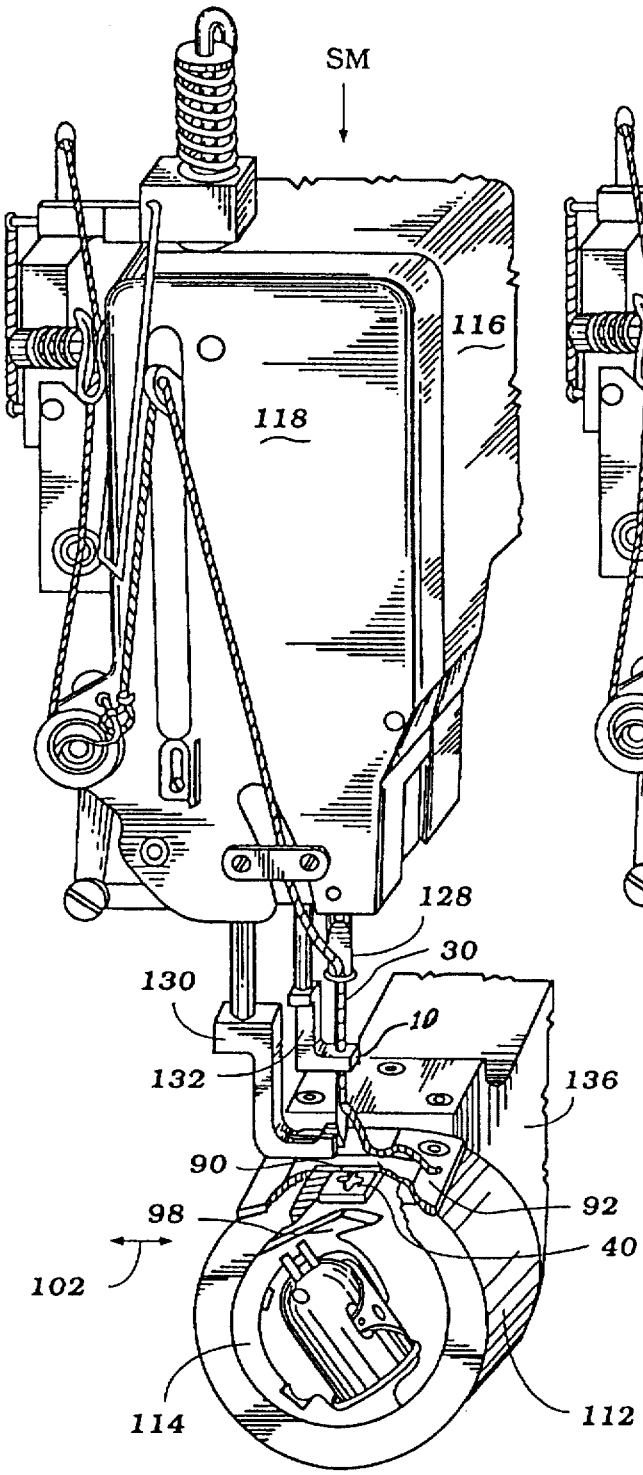
FIG. 21 is a perspective view of a portion of a sewing machine having a compound feed mechanism.

Referring to FIG. 21, a sewing machine SM having a compound feed mechanism is shown to include a material support plate 92 atop an orbital shuttle chamber 112. An orbital shuttle 114 is carried within the shuttle chamber 112. The orbital shuttle 114 carries the shuttle hook 98. The sewing machine SM also includes an upper housing 116 including an end portion 118 located above the material support plate 92. The material support plate 92 includes the needle-receiving slot 90, which is relatively narrow and is elongated in the direction of material advancement across the material support plate 92, which direction is indicated by arrow 102. The sewing needle 30 extends downwardly toward the needle-receiving slot 90. The upper end of the needle 30 is secured to the lower end of a needle bar 128. A main presser foot or outer presser foot 130 is positioned forwardly of the needle 30 in the path of material movement through the sewing machine SM. A center presser foot 132 is positioned between the needle 30 and the outer presser foot 130. The center presser foot 132 includes the upper needle guide 10 with the needle hole therein through which the needle 30 reciprocates.

The lower portion of the material support plate 92 and surrounding portions of the shuttle chamber 112 are cut away to reveal the lower needle guide 40 positioned below the material support plate 92. The lower needle guide 40 is mounted to an eccentric (not shown) that is part of a four-motion drive mechanism within the lower portion 136 of the sewing machine SM. This drive mechanism is coupled to the drive mechanisms for the needle bar 128 and center presser foot 132. The center presser foot 132, sewing needle 30, and lower needle guide 40 move in unison in the direction of arrow 102 to advance the material along the stitching path.

Figure 22:
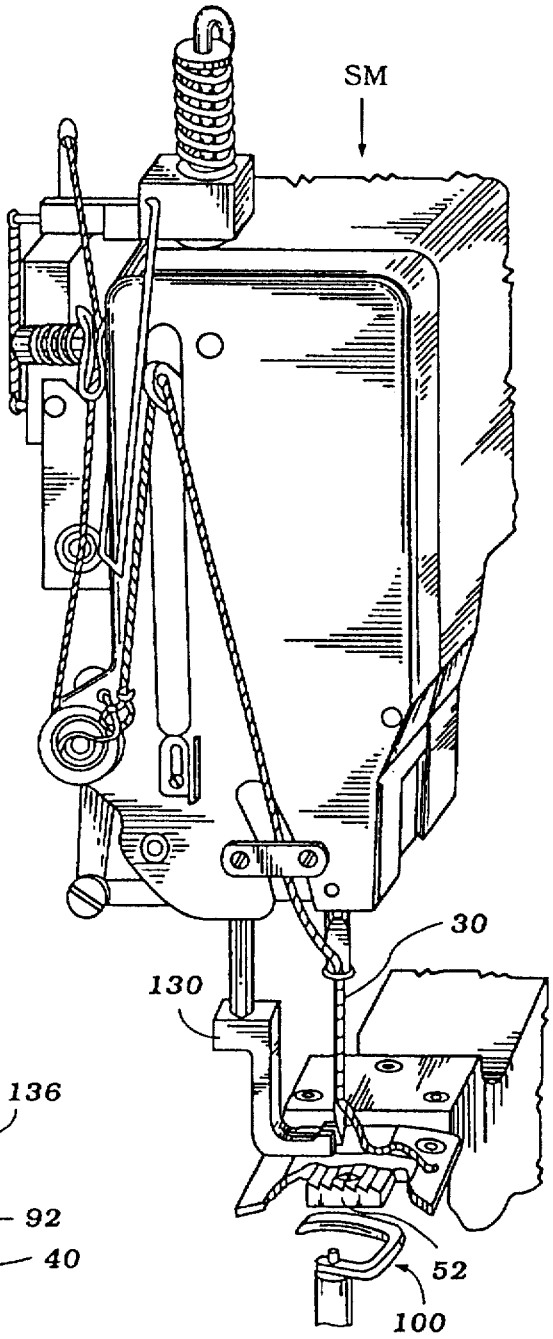
FIG. 22 is a perspective view of a sewing machine having a needle feed mechanism.

Referring to FIG. 22, a sewing machine SM having a needle feed mechanism and a thread loop pick-up device in the form of a thread looper 100 is shown. The needle feed mechanism does not include the center presser foot of FIG. 21, although such a device could be provided for the needle feed mechanism shown in FIG. 22. The thread looper 100 is positioned beneath the feed dog 52 in position to catch the thread loop thrown by the sewing needle 30 beneath the feed dog. The feed dog 52 is mounted onto an eccentric that is part of a four-motion drive mechanism similar to the one that the lower guide plate 40 of FIG. 21 is mounted onto. With a needle feed mechanism, the sewing needle 30 and the feed dog 52, in conjunction, advance the material along the stitching path. The main presser foot 130 holds the material as the needle 30 and the feed dog 52 are repositioned for a subsequent stitch.

It is to be understood that many variations in size, shape, and construction can be made to the illustrated and above-described embodiment without departing from the spirit and scope of the present invention. Some of the features of the preferred embodiment may be utilized without other features. Therefore, it is to be understood that the presently described and illustrated embodiment is non-limitive and is for illustration only. Instead, my patent is to be limited for this invention only by the following claim or claims interpreted according to accepted doctrines of claim interpretation, including the doctrine of equivalence and reversal of parts.

What is claimed is:

1. A sewing machine, comprising:

a material supporting surface including a vertical needle receiving opening;

a needle supported above the material supporting surface for up and down reciprocation, said needle including a portion that is within the needle receiving opening, said needle also including a longitudinal first groove on one side thereof for receiving thread that extends downwardly along the needle and through the needle receiving opening in the material support surface;

a presser foot that sits down onto material being sewn that is on the material supporting surface, said presser foot including a vertical, substantially circular needle receiving opening that is slightly larger than the diameter of the needle so that there is a close fit of the needle in the opening; and a vertical second groove formed in said presser foot, alongside the needle receiving opening, said second groove opening laterally into the needle receiving opening, in substantial lateral alignment with the thread receiving first groove in the needle, said first and second grooves together providing a passageway for the thread so that the thread can feed freely through the presser foot without being pinched between the needle and an edge surface of the needle receiving opening in the presser foot.

2. The sewing machine of claim 1, further comprising a compound feed mechanism for advancing the material along a stitching path, said compound feed mechanism including a reciprocating needle bar to which the needle is connected, a center feed bar that includes the presser foot, a lower needle guide below the material supporting surface for guiding a lower portion of the needle that is below the material supporting surface, and a drive mechanism for reciprocating the needle bar, the center feed bar and the lower needle guide in unison in a first direction along the stitching path, to advance material being sewn and for reciprocating the needle bar, the center feed bar and the lower needle guide in a second, opposite direction along the stitching path to reposition the needle bar, the center feed bar and the lower needle guide for a subsequent stitch.

3. The sewing machine of claim 1, wherein the lower needle guide comprises a guide plate including a vertical opening therein for receiving the lower portion of the needle, said guide plate also including a pair of notches on opposite sides of the vertical opening that are in line with the stitching path, whereby upon advancement of material being sewn, the center feed bar guides the upper portion of the needle and the lower needle guide guides the lower portion of the needle and if the material tends to urge the needle out of proper alignment, the lower portion of the needle is captured in one of the notches of the lower needle guide and is moved back into a position of proper alignment.

* * * * *

UNITED STATES PATENT AND TRADEMARK OFFICE

CERTIFICATE OF CORRECTION

PATENT NO: 5,762,014

DATED: June 9, 1998

INVENTOR(S): Ferdinand H. JeanBlanc

It is certified that error appears in the above-identified patent and that said Letters Patent is hereby corrected as shown below:

Claim 1, column 10, line 4, "along" should be -- alongside --.

Signed and Sealed this

Twelfth Day of January, 1999

*Attest:*

*Attesting Officer*

*Acting Commissioner of Patents and Trademarks*